United States Patent [19]

Lategan et al.

[11] Patent Number: 4,819,338

[45] Date of Patent: Apr. 11, 1989

[54] DRAWING INSTRUMENTS

[75] Inventors: Christiaan B. Lategan, Randburg; Theodore E. Schwellnus, Verwoerdburg, both of South Africa

[73] Assignee: Cibela Patents C.C., Randburg, South Africa

[21] Appl. No.: 26,141

[22] Filed: Mar. 16, 1987

[30] Foreign Application Priority Data

Mar. 20, 1986 [ZA] South Africa ..... 86/2080

[51] Int. Cl.[4] ..... B43I 13/02

[52] U.S. Cl. ..... 33/437; 33/482; 33/479

[58] Field of Search ..... 33/430, 437, 474, 429, 33/482, 438, 419, 434, 432, 433, 1 AA, 1 G, 1 K, 436, 443, 446

[56] References Cited

U.S. PATENT DOCUMENTS

| | | | |
|---|---|---|---|
| 1,682,035 | 8/1928 | Clark | 33/474 |
| 2,219,766 | 10/1940 | Cotterman | 33/437 |
| 2,247,362 | 7/1941 | Dibble | 33/474 |
| 3,589,016 | 6/1971 | Hebel | 33/437 |

FOREIGN PATENT DOCUMENTS

| | | | |
|---|---|---|---|
| 102293 | 10/1937 | Australia | 33/429 |
| 2018666 | 10/1971 | Fed. Rep. of Germany | 33/430 |
| 9152 | of 1892 | United Kingdom | 33/429 |
| 373334 | 5/1932 | United Kingdom | 33/474 |

*Primary Examiner*—Harry N. Haroian
*Attorney, Agent, or Firm*—Ladas & Parry

[57] ABSTRACT

A drawing board and drawing instrument combination is provided. The drawing board has grooves along three of its edges and at 45° across the corners which can receive tongues provided on either side of a flat drawing instrument. The instrument has a number of straight edges which overlie the board in use and which make different angles to the edge of the board. The instrument serves as a T-square and also as a set-square, and is reversible.

12 Claims, 2 Drawing Sheets

DRAWING INSTRUMENTS

BACKGROUND OF THE INVENTION

This invention relates to a drawing board and drawing instrument combination.

South African Pat. No. 74/8011 describes a drawing board and drawing instrument combination in which a T-square is provided with a tongue which fits into a complementary groove provided at the edge of a drawing board, the tongue being slidable in the groove. This arrangement is particularly useful for portable drawing board and drawing instrument combinations.

SUMMARY OF THE INVENTION

According to the invention there is provided a drawing board and drawing instrument combination in which the drawing board is planar and has at least one engaging formation adjacent an edge of the board which is adapted to engage slidably with at least one complemental formation on the instrument; the instrument being substantially flat and having a plurality of straight edges at least three of which are adapted to overlie the board and define different angles to the edge of the board in use.

The instrument may be provided with complemental formations on both of its flats sides.

The board may be rectangular and be provided with engaging formations on its upper surface along three of its edges.

The board may be provided with a further engaging formation across at least one corner of the board.

Preferably the engaging formation is a groove and the complemental formation is a tongue.

DESCRIPTION OF A PREFERRED EMBODIMENT

The drawings show a portable drawing board 10 and a drawing instrument 12. The board 10 is rectangular with a planar upper surface, and is moulded from a plastics material. Linear engaging formations in the form of grooves 14 are provided in the upper surface of the board 10 along three of its edges. Further grooves 16 are provided across the lower corners of the board 10, at 45° to the edges of the board 10 adjacent the corners.

Figure 2:
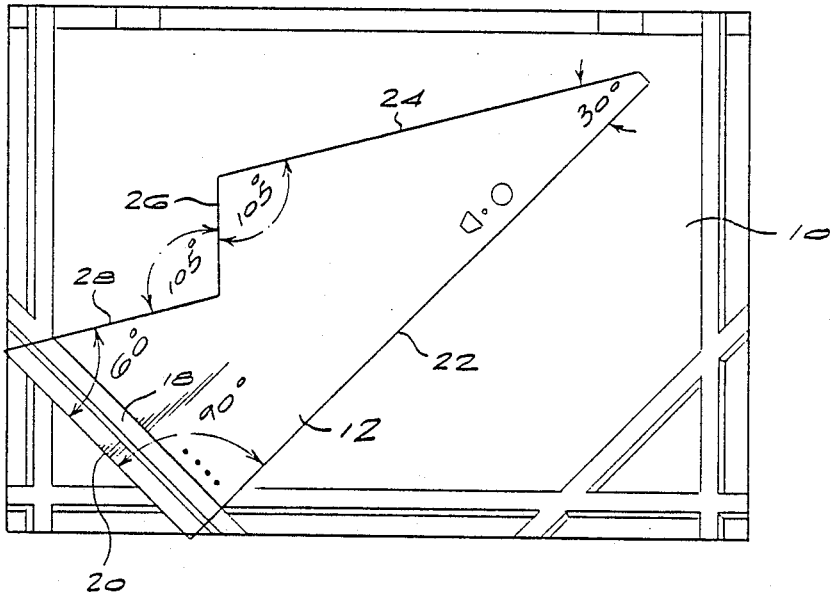
FIG. 2 shows the combination of FIG. 1 with the instrument in a different position on the board.
Figure 3:
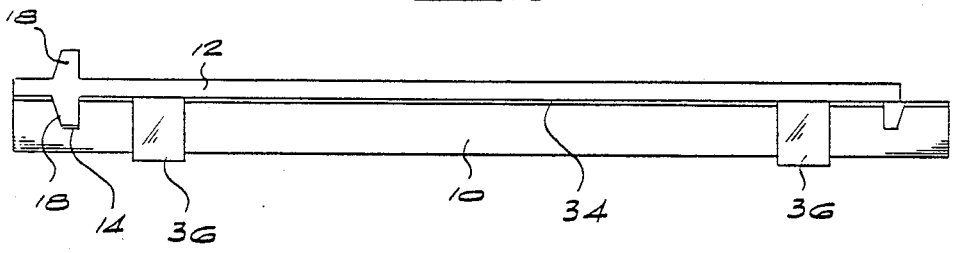
FIG. 3 is a side view of the combination showing how the instrument engages with the board.
Figure 4:
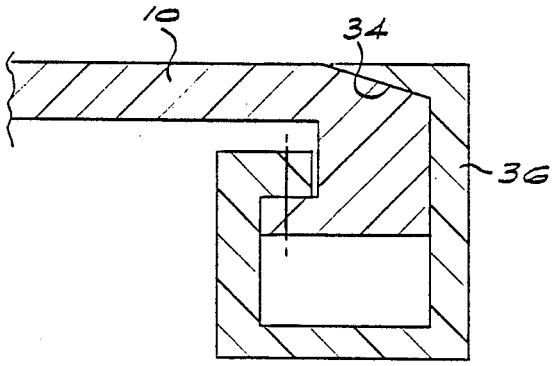
FIG. 4 is a side view showing a clip fitted to the board.

As can best be seen from FIG. 2, the drawing instrument 12 is flat and is provided with complementary engaging formations on its opposite flat sides which are in the form of tongues 18 adapted to fit slidably into the grooves 14 and 16. The grooves 14 and 16 have a first side which is normal to the upper surface of the board 10, and a second side which is inclined relative to the upper surface of the board 10. The tongues 18 are complementally shaped and the height of the tongues is somewhat less than the depth of the grooves 14 and 16 so that the tongues do not come into contact with the bases of the grooves in use. When a tongue 18 of the drawing instrument 12 is pressed down into the groove 14 or 16, the reactive force at the interface of the inclined side of the groove 14 or 16 and the tongue 18 forces the tongue 18 firmly against the side of the groove 14 or 16 which is normal to the surface of the board 10, so that the instrument 12 is correctly aligned.

Figure 1:
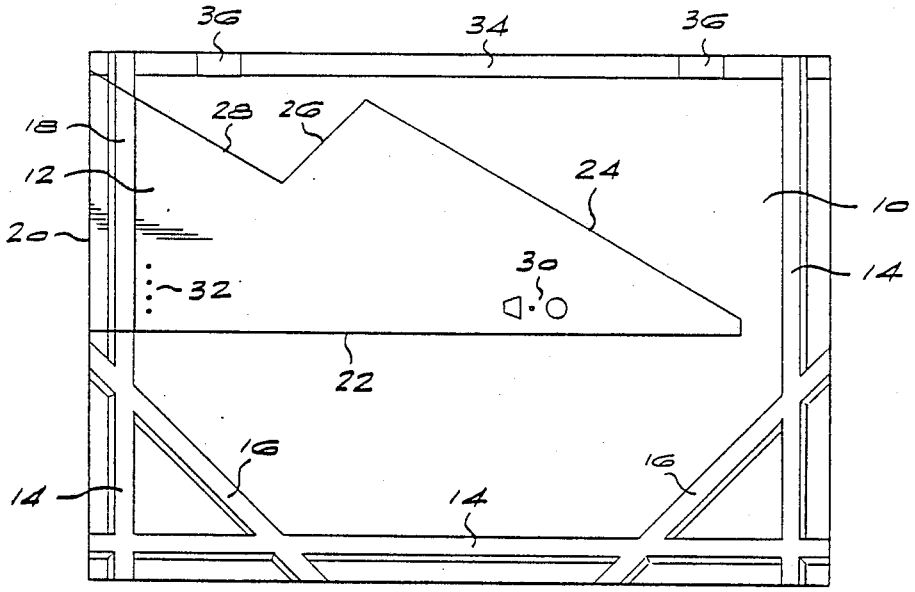
FIG. 1 is a top view of a drawing board and drawing instrument combination according to the invention.

The drawing instrument 12 in FIGS. 1 and 2 has five edges 20, 22, 24, 26, and 28. The first edge 20 and the second edge 22 are at right angles to one another. The third, fourth and fifth edges 24, 26, and 28 respectively, lie between the extreme ends of the first and second edges 20 and 22. The third edge 24 forms an angle of 30° with the second edge 22, and the fifth edge 28 forms an angle of 60° with the first edge 20, so that the edges 28 and 24 are parallel to one another. The fourth edge 26 forms an angle of 105° with the edges 24 and 28, the latter two edges being parallel.

It can clearly be seen from FIGS. 1 and 2 that by placing the drawing instrument 12 in the various grooves and by reversing it, a considerable number of different angles can be drawn, because the edges are at different angles to the complementary engaging formations. It is thus unnecessary to have a separate T-square and set-square, since the standard angles of 30°, 45°, 60°, 75° and 90° are provided.

The drawing instrument 12 includes templates 30 and 32. The template 30 comprises symbols which enable a draughtsman to draw first or third angle projection symbols. The template 32 comprises a series of small apertures which are aligned so as to enable the draughtsman to easily demarcate a title block on his drawing paper, and to correctly mark the borders of his drawing. Small bumps are provided on each side of the drawing instrument 12 which serve to raise it slightly off the drawing paper in use and allow it to slide easily.

A bevelled edge 34 is provided along an edge of the drawing board 10. Two plastic clips 36 are attached to the underside of the drawing board 10 and are shaped complementally to the angle of the bevelling 34 so that in their operative position they do not extend above the surface of the board 10. The clips 36 protrude below the bottom of the board 10, so that pressure on the board 10 loosens the clips to enable paper to be inserted or removed. Other clips could, of course, be used instead. In particular, a single clip extending the length of the board can be provided.

Figure 5:
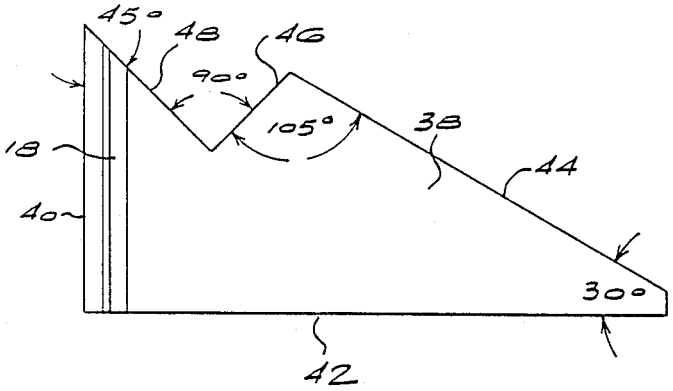
FIG. 5 shows an alternative drawing instrument.

In FIG. 5, an alternative drawing instrument 38 is illustrated. The instrument 38 has five edges 40, 42, 44, 46 and 48. The instrument 38 differs from the instrument 12*i* that the angle between the sides 40 and 48 is 45° instead of 60° and the angle between the sides 46 and 48 is 90° and not 105°. Other combinations of angles can be chosen for particular purposes.

We claim:

1. A drawing board and drawing instrument combination, comprising:

a drawing board having a rectangular planar surface with four edges, corners between the edges, and linear engaging formations formed on the board respectively adjacent three of the edges and across the two corners therebetween at 45° to the edges thereat; and a drawing instrument having opposite, substantially-flat sides with at least two straight edges therebetween, and complementary engaging formations respectively on the opposite sides for fitting slidably along the linear engaging formations of the drawing board when the corresponding side of the drawing instrument is on the planar surface of the drawing board, the straight edges of the drawing instrument being at different angles to the complementary engaging formations.

2. A drawing board and drawing instrument combination wherein the drawing board is planar and rectangular and defines engaging formations formed on the board adjacent at least three contiguous edges of the board, further engaging formations being provided across two corners of the board between the three contiguous edges thereof and being disposed at 45° to the said edges; the instrument being substantially flat and having at least two straight edges which define different angles to the edges of the board in use, the instrument being reversible and having on each flat side a formation complemental to the engaging formations on the board, to allow the instrument to be slid on the surface of the board with a formation on the instrument engaged with a formation on the board.

3. A combination according to claim 2 in which each engaging formation on the board is a groove and each complemental formation on the instrument is a tongue.

4. A combination according to claim 2 in which the instrument has adjoining first and second edges at right angles to one another and contiguous third, fourth and fifth edges joining the extreme ends of the first and second edges, the second and third and the first and fifth edges defining acute angles relative to one another, and the complemental formation being provided adjacent the first edge.

5. A combination according to claim 4 in which the third and fifth edges are parallel.

6. A combination according to claim 5 in which the second and third edges edges define an angle of 30° and the first and fifth edges define an angle of 60° relative to one another.

7. A combination according to claim 6 in which the fourth edge defines an angle of 105° to the third and fifth edges.

8. A combination according to claim 4 in which the second and third edges define an angle of 30°, the first and fifth edges define an angle of 60° and the third and fourth edges define an angle of 105° relative to one another.

9. A combination according to claim 2 in which the instrument includes a template for drawing one or more standard symbols.

10. A combination according to claim 2 in which a fourth edge of the board is bevelled on its upper surface and at least one clip is provided for holding paper to the bevelled edge of the board which has a profile complementary to the bevelling so that the clip does not protrude above the surface of the board in use.

11. A combination according to claim 10 in which the clips are spring clips which are attached to the board and protrude below the underside of the board, so that pressure on the upper surface of the board loosens the clips.

12. A combination according to claim 2 in which the drawing board and the drawing instrument are moulded in a plastics material.

* * * * *